US005829269A

United States Patent [19]

Pecoud et al.

[11] Patent Number: 5,829,269

[45] Date of Patent: Nov. 3, 1998

[54] METHOD OF AND PLANT FOR RELIQUEFYING GASEOUS HELIUM

[75] Inventors: Yves Pecoud, Moirans; Pierre Briend, Seyssinent; Jean-Claude Villard, Echirolles; Guy Gistau Baguer, Biviers, all of France

[73] Assignee: L'Air Liquide, Societe Anonyme Pour L'Etude et L'Exploitation de Procedes Georges Claude, Paris Cedex, France

[21] Appl. No.: 897,837

[22] Filed: Jul. 21, 1997

[30] Foreign Application Priority Data

Aug. 5, 1996 [FR] France ..... 96 09876

[51] Int. Cl.[6] ..... F25B 1/00

[52] U.S. Cl. ..... 62/608; 62/48.2

[58] Field of Search ..... 62/48.2, 48.3, 62/608

[56] References Cited

U.S. PATENT DOCUMENTS 3,150,495 9/1964 Reed ..... 62/48.2
3,303,660 2/1967 Berg ..... 62/48.2
4,637,216 1/1987 Shenoy et al. .
4,727,723 3/1988 Durr ..... 62/48.2
4,886,534 12/1989 Castan ..... 62/48.2

FOREIGN PATENT DOCUMENTS 0 520 937 12/1992 European Pat. Off. .

*Primary Examiner*—Ronald C. Capossela
*Attorney, Agent, or Firm*—Young & Thompson

[57] ABSTRACT

Method of reliquefying gaseous helium produced when transferring liquid helium from a donor container (R1) to a receiver container (R2), characterized in that a stream of gaseous helium is bled off from a point in a compression unit (10) intended for charging with gaseous helium under pressure, this stream of gaseous helium is cooled by heat exchange with the gaseous helium intended for the compression unit (10) and the compressed gaseous helium thus cooled is expanded in order to obtain reliquefied helium.

7 Claims, 1 Drawing Sheet

METHOD OF AND PLANT FOR RELIQUEFYING GASEOUS HELIUM

FIELD OF THE INVENTION

Figure 1:
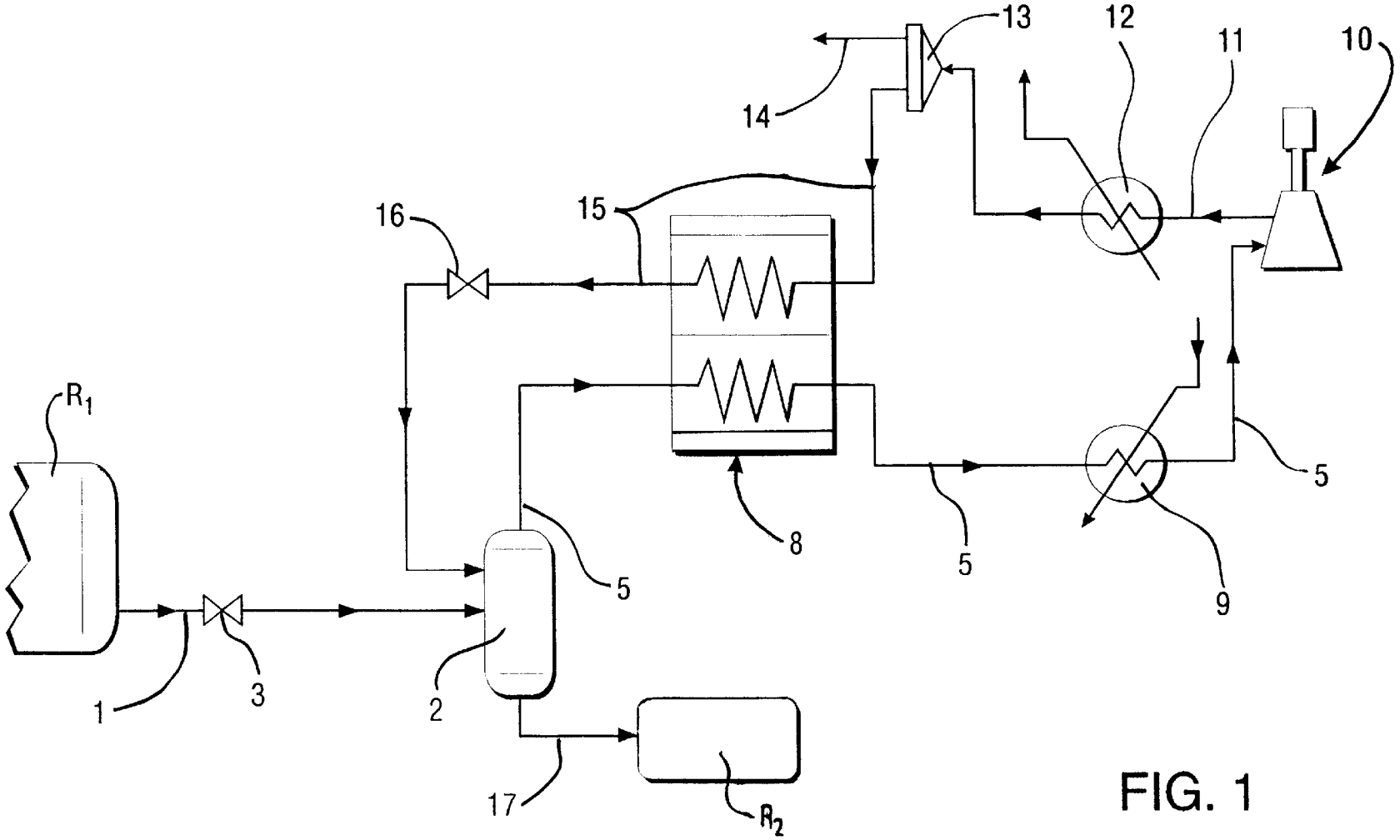

The present invention relates to a method of reliquefying gaseous helium produced when transferring liquid helium from a donor container to a receiver container.

BACKGROUND OF THE INVENTION

When transferring liquid helium from a donor container to a receiver container of small or large volume, it is known to reliquefy the cold helium vapour which results from the expansion of the liquid helium and from the heat losses when transferring it. This reliquefaction is carried out by means of a specific piece of equipment which is particularly complex and expensive.

According to another, more common technique, the cold helium vapour is recovered and pressurized in pieces of equipment called HCCs (helium charging centres) which essentially consist of a multistage compression unit capable, for example, of filling bottles with gaseous helium at a pressure of $200\times10^5$ Pa.

SUMMARY OF THE INVENTION

The object of the present invention is to provide a method which makes it possible to improve, from an economic standpoint, the ratio of liquid transferred between the donor container and the receiver container by reliquefying at least some of the cold helium vapour produced during its transfer.

For this purpose, the method of liquefying gaseous helium produced when transferring liquid helium from a donor container to a receiver container is characterized in that a stream of gaseous helium is bled off from a point in a compression unit intended for charging with gaseous helium under pressure, this stream of compressed gaseous helium is cooled by heat exchange with the gaseous helium intended for the said compression unit and the compressed gaseous helium thus cooled is expanded in order to obtain reliquefied helium.

The method according to the invention may include one or more of the following characteristics:

- the stream of compressed gas is cooled by a countercurrent flow of the gaseous helium intended for the compression unit;
- the stream of gaseous helium is bled off from a point in the compression unit in order to make available a level of pressure compatible with reliquefaction;
- the compressed and cooled gaseous helium is expanded by means of a valve of the JT (Joule-Thomson) type.

The subject of the invention is also a plant for reliquefying gaseous helium produced when transferring liquid helium from a donor container to a receiver container, characterized in that it comprises, in the direction of flow of the helium leaving the donor container:

- a phase separator receiving, on the one hand, the helium coming from the donor container and, on the other hand, the reliquefied helium;
- a first line leading from the top of the phase separator to the inlet of a compression unit intended for charging with gaseous helium under pressure;
- a second line, going from the compression unit, leading to the phase separator;
- a heat exchanger putting the two lines into heat-exchange relationship; and

- a valve of the JT (Joule-Thomson) type placed downstream of the exchanger in the second line.

The plant according to the invention may include one or more of the following characteristics:

- the exchanger is of the indirect countercurrent type;
- the second line going from the compression unit is fitted with a flow distributor and a third line, intended for charging with a fraction of the gaseous helium compressed by this unit, goes from this flow distributor.

BRIEF DESCRIPTION OF THE INVENTION

An example of implementation of the invention will now be described with regard to the appended drawing, the single figure of which shows diagrammatically a plant according to the invention.

The plant is intended to transfer liquid helium from a donor container R1, in which it is stored at a pressure P1, to another storage vessel R2, typically a much smaller receiver container, at a pressure P2<P1. For example P1 is of the order of a few bar and P2 is close to atmospheric pressure. The plant comprises a line 1, suitable for transporting liquid helium, which is connected to the lower part of the liquid-helium container R1 so as to transport helium to a phase separator 2. The line 1 is fitted upstream of the phase separator 2 with an expansion valve 3.

The phase separator 2 has at the top of it a first outlet line 5. The latter passes through an indirect countercurrent heat exchanger 8. Downstream of the countercurrent exchanger 8, the line 5 is fitted with an atmospheric-air heater 9 before connection to the inlet of a compression unit 10 of the HCC type, as described above.

The unit 10 compresses the gaseous helium close to ambient temperature coming from the line 5 to a pressure P3 of about 15 to $20\times10^5$ Pa. The unit 10 has an outlet line 11 fitted with a water cooler 12 and a flow distributor 13. The latter has a first outlet line 14 for charging helium bottles at high pressures of about $200\times10^5$ Pa, with recompression, and a second outlet line 15, which passes through the countercurrent exchanger 8, in heat-exchange relationship with the line 5. The line 15 is fitted, downstream of the exchanger 8, with a valve 16 of the JT (Joule-Thomson) type before it runs into the phase separator 2. The latter has, in its lower part and opposite the line 5, another outlet line 17 which is connected to the storage vessel R2.

The operation of the plant is as follows.

The helium leaving the donor container R1 is conveyed, by means of the line 1, to the phase separator 2 after expansion to a pressure P2 in the valve 3.

The gaseous helium contained in the separator 2 resulting from the expansion in 3 and from the heat losses from the line 1, is then transported by means of the line 5 through the countercurrent exchanger 8 and brought back close to ambient temperature in 9, before reaching the inlet of the compression unit 10.

The gaseous helium is bled off from a point in the compression unit 10, in order to make available a level of pressure P3 compatible with reliquefaction, is cooled down to close to ambient temperature in 12 and is transported, by means of the line 11, to the flow distributor 13. The latter enables the compressed gaseous helium to be conveyed either along the line 14 in order to be further pressurized and to fill bottles, or along the line 15 which goes through the exchanger 8.

The gaseous helium compressed to the pressure P3, conveyed via the line 15, is cooled inside the exchanger 8 by means of the gaseous helium flowing as countercurrent in the line 5.

The compressed gaseous helium thus cooled is then transported via the same line 15 to the valve 16 of the JT (Joule-Thomson) type so as to be expanded therein from the pressure P3 to the pressure P2, and partially liquefied.

Under these conditions, the expanded helium is transported via the line 15 into the phase separator 2. The liquid helium contained in the latter is then conveyed via the line 17 into the storage vessel R2.

It should, however, be understood that the above description was given merely by way of example and that it in no way limits the scope of the invention, from which one would not depart by replacing the execution details described by any other details which are equivalent.

We claim:

1. Method of reliquefying gaseous helium produced when transferring liquid helium from a donor container to a receiver container, which comprises:

bleeding off a stream of gaseous helium from a point in a compression unit intended for charging with gaseous helium under pressure;

cooling the stream of gaseous helium by heat exchange with the gaseous helium intended for the compression unit; and expanding the compressed gaseous helium thus cooled in order to obtain a reliquefied helium.

2. Method according to claim 1, wherein the stream of compressed gaseous helium is cooled by a countercurrent flow of the gaseous helium intended for the compression unit.

3. Method according to claim 1, wherein the stream of gaseous helium is bled off from a point in the compression unit in order to make available a level of pressure compatible with reliquefication.

4. Method according to claim 1, wherein the compressed and cooled gaseous helium is expanded with a Joule-Thomson valve.

5. Plant for reliquefying gaseous helium produced when transferring liquid helium from a donor container to a receiver container, which comprises, in the direction of flow of the helium leaving the donor container:

a phase separator including a first inlet means for receiving the helium coming from the donor container, and a second inlet means for receiving reliquefied helium;

a first line leading from the top of the phase separator to the inlet of the compression unit intended for charging with gaseous helium under pressure;

a second line going from the compression unit and communicating with the phase separator via the second inlet means;

a heat exchanger for bringing the two lines into heat-exchange relationship; and a Joule-Thomson valve placed on the downstream side of the exchanger in the second line.

6. Plant according to claim 5, wherein the exchanger is an indirect countercurrent exchanger.

7. Plant according to claim 5, wherein the second line going from the compression unit includes a flow distributor, which has an outlet intended for charging bottles with a fraction of the gaseous helium compressed by the compression unit.

* * * * *